United States Patent [19]

Staab et al.

[11] Patent Number: 4,584,080

[45] Date of Patent: Apr. 22, 1986

[54] BIPOLAR ELECTROLYSIS APPARATUS WITH GAS DIFFUSION CATHODE

[75] Inventors: Rudolf Staab; Kurt Hannesen, both of Kelkheim, Fed. Rep. of Germany

[73] Assignee: Hoechst Aktiengesellschaft, Fed. Rep. of Germany

[21] Appl. No.: 738,874

[22] Filed: May 29, 1985

[30] Foreign Application Priority Data

Jun. 1, 1984 [DE] Fed. Rep. of Germany ..... 3420483

[51] Int. Cl.[4] ..... C25B 9/00; C25B 9/02

[52] U.S. Cl. ..... 204/255; 204/268; 204/279; 204/286

[58] Field of Search ..... 204/98, 128, 253–256, 204/263–266, 279, 286, 294, 268

[56] References Cited

U.S. PATENT DOCUMENTS

| | | | |
|---|---|---|---|
| 4,116,805 | 9/1978 | Ichisaka et al. | 204/254 |
| 4,141,815 | 2/1979 | Ichisaka et al. | 204/254 |
| 4,217,199 | 8/1980 | Cunningham | 204/256 |
| 4,279,731 | 7/1981 | Pellegri | 204/254 |
| 4,309,264 | 1/1982 | Bender et al. | 204/256 |
| 4,389,289 | 6/1983 | de Nora | 204/255 |
| 4,402,809 | 9/1983 | Dilmore et al. | 204/254 |
| 4,411,749 | 10/1983 | Sato et al. | 204/98 |
| 4,425,214 | 1/1984 | Pellegri | 204/254 |
| 4,472,255 | 9/1984 | Millington et al. | 204/255 |
| 4,488,946 | 12/1984 | Morris et al. | 204/254 |

*Primary Examiner*—John F. Niebling
*Assistant Examiner*—Terryence Chapman
*Attorney, Agent, or Firm*—Connolly and Hutz

[57] ABSTRACT

In this electrolysis apparatus, the anode and the gas diffusion cathode are arranged to be separated from one another by means of a partition. At least one element (6) which has the form of a twin trough is located between two half-shells (1, 2) which are located at the ends and of which one carries an anode (4) and the second carries a cathode (5). This twin trough is formed by a common plate (7) and a lateral wall (8), the height of which is divided by the plate and the edges of which are provided with flanges (9, 10). The anode (4) and the cathode (5) are electrically conductively connected to the wall (8) and to struts (13) which protrude vertically from the plate on both sides. In order to form a cavity (16) between the partition (14) and the cathode (5), a sealing element is arranged between these two.

6 Claims, 3 Drawing Figures

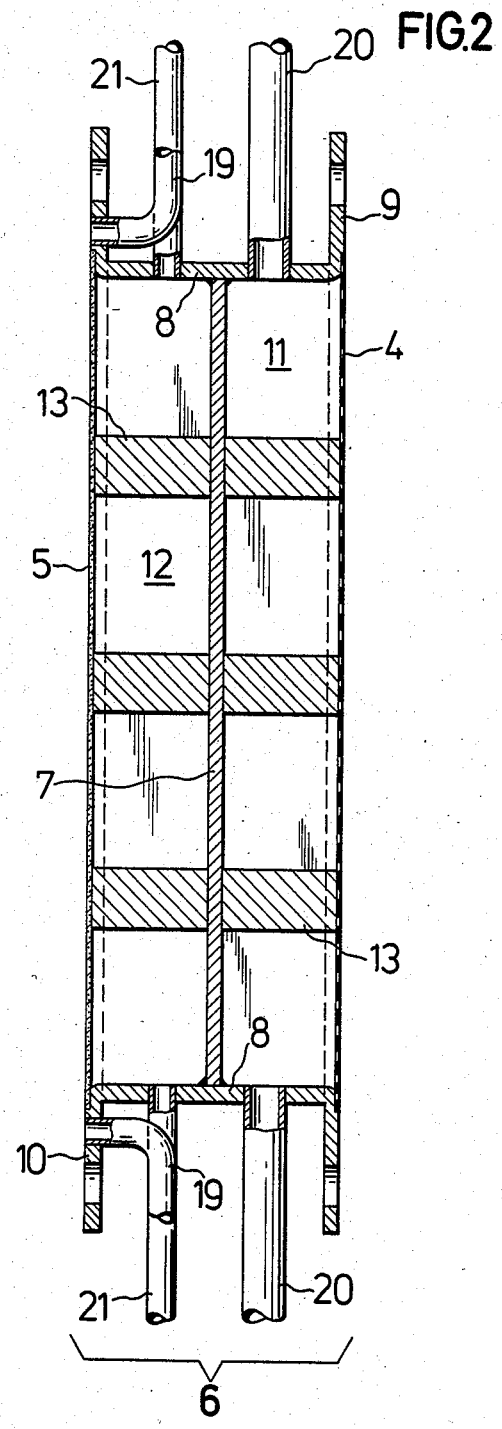
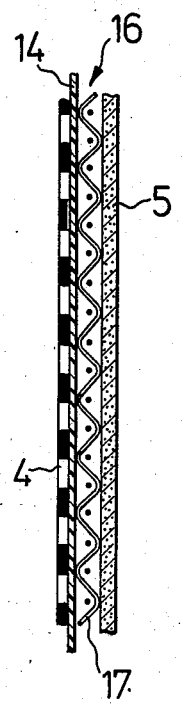
FIG.3

BIPOLAR ELECTROLYSIS APPARATUS WITH GAS DIFFUSION CATHODE

BACKGROUND OF THE INVENTION

The present invention relates to a bipolar electrolysis apparatus with an oxygen-consuming cathode for the production of chlorine and caustic soda from aqueous alkali metal chloride solution, with devices for supplying the electrolysis current and the electrolysis feed materials and for discharging the electrolysis output products, the anode and cathode being arranged to be separated from one another by means of a partition.

The electrolysis of aqueous sodium chloride is an important process for the production of the heavy chemicals chlorine and caustic soda. A modern variant is carried out in a membrane cell. In this process, the electrolysis cell consists of an anode space with an anode and a cathode space with a cathode, and of a cation exchanger membrane which separates the two electrolysis spaces from one another. When a saturated sodium chloride solution is fed into the anode space, the chloride ions are discharged at the anode to elemental chlorine under the action of the electric current. At the same time, a decomposition of water with the formation of elemental hydrogen and hydroxide ions takes place at the cathode. Approximately at the same rate as that of the generation of hydroxide ions, sodium ions migrate from the anode space through the cation exchanger membrane into the cathode space. The underlying chemical reaction corresponds to the following equation:

$$2\ NaCl + 2\ H_2O \rightarrow 2\ NaOH + Cl_2 + H_2$$

For the anode space of an electrolysis cell, in which an alkali metal chloride, such as, for example, sodium chloride, potassium chloride or lithium chloride, is to be electrolyzed, a material must be used which is resistant to the corrosive medium which contains high chloride ion concentrations and elemental chlorine. In the state of the art, titanium, iridium or precious metals are used, and titanium metal is preferred which can have been superficially activated with a mixed oxide in order to reduce the chlorine overvoltage and at the same time to increase the oxygen overvoltage. The anode likewise consists of titanium, which can have been activated by transition metal oxides, such as ruthenium oxide or iridium oxide, in order to lower the chlorine overvoltage and at the same time to increase the oxygen overvoltage.

Titanium cannot be used as the material for the cathode space, since the hydrogen formed would cause an embrittlement of the titanium metal. The cathode space is therefore made of ordinary steel, stainless steel, nickel or nickel-plated steel. The cathode likewise consists of these materials, but it can additionally have been activated by precious metals or other electro-catalysts, such as, for example, Raney nickel or sulfur-containing nickel. Electrochemical cells for the alkali metal chloride electrolysis additionally contain a diaphragm or a cation exchanger membrane, which separates the anode space and cathode space from one another. Cation exchanger diaphragms, i.e. perfluorinated membrane containing sulfonic acid groups or carboxyl groups, are preferably used, if highly pure caustic soda is to be obtained. The membranes are cation-selective, that is to say they allow only the sodium ions to pass through in sodium chloride electrolysis, whereas the chloride ions remain in the anode space.

In practice, larger electrolyzers are assembled from such electrolysis cells which consist of the anode space with the anode, the cathode space with the cathode and the cation exchanger membrane, and these electrolyzers can consist of a multiplicity of individual cells. Monopolar or bipolar connection can be used for such electrolyzers. Bipolar connections are preferred, since very large cell units can be operated with these.

Difficulties arise, however, in the current transition from cell to cell. Because of the different materials of cathode space and anode space, the current being conducted in each case via the rear wall thereof, and above all because of the passivation of the titanium in an air atmosphere, large transition resistances and hence considerable voltage losses occur.

SUMMARY OF THE INVENTION

It was therefore the object to provide an electrochemical cell which consists of simple components and can be assembled into large electrolyzers and which, with bipolar connection, guarantees optimum current conduction from cell to cell.

The invention, as defined in the patent claims, achieves the object in such a way that at least one element in the form of a twin trough is located between two half-shells which have edges formed as a flange and of which one carries an anode and the second carries a cathode, which twin trough is formed by a common plate and a lateral wall, the height of which is divided by the plate and the edges of which are provided with flanges, the anode and the cathode which are separated from one another in space by the plate are electrically conductively connnected to the wall and to struts which protrude vertically from the plate on both sides, the partitions are clamped in between the flanges of the half-shells and of the element, and sealing elements are arranged in such a way that a cavity is formed between the partition and the cathode.

In an embodiment, two or more elements can be located between the half-shells. The partition is clamped in between the flanges of the elements and a sealing element is arranged in such a way that a cavity is formed between the partition and the cathode. A spacer can be located between the partition and the cathode, and the sealing element can have recesses which connect the cavity between the partition and the cathode to devices for feeding and discharging the catholyte. The material used for the half-shells and the elements can be titanium. A suitable anode material is titanium which has been activated by an oxide or mixed oxide of the metals of the 8th subgroup of the Periodic Table.

BRIEF DESCRIPTION OF THE DRAWINGS

The invention is explained in more detail below by reference to drawings which represent only one possible embodiment and in which:

FIG. 2 shows a section through an element, and FIG. 3 shows an enlarged detail "Z" of FIG. 1.

DETAILED DESCRIPTION OF THE INVENTION

Figure 1:
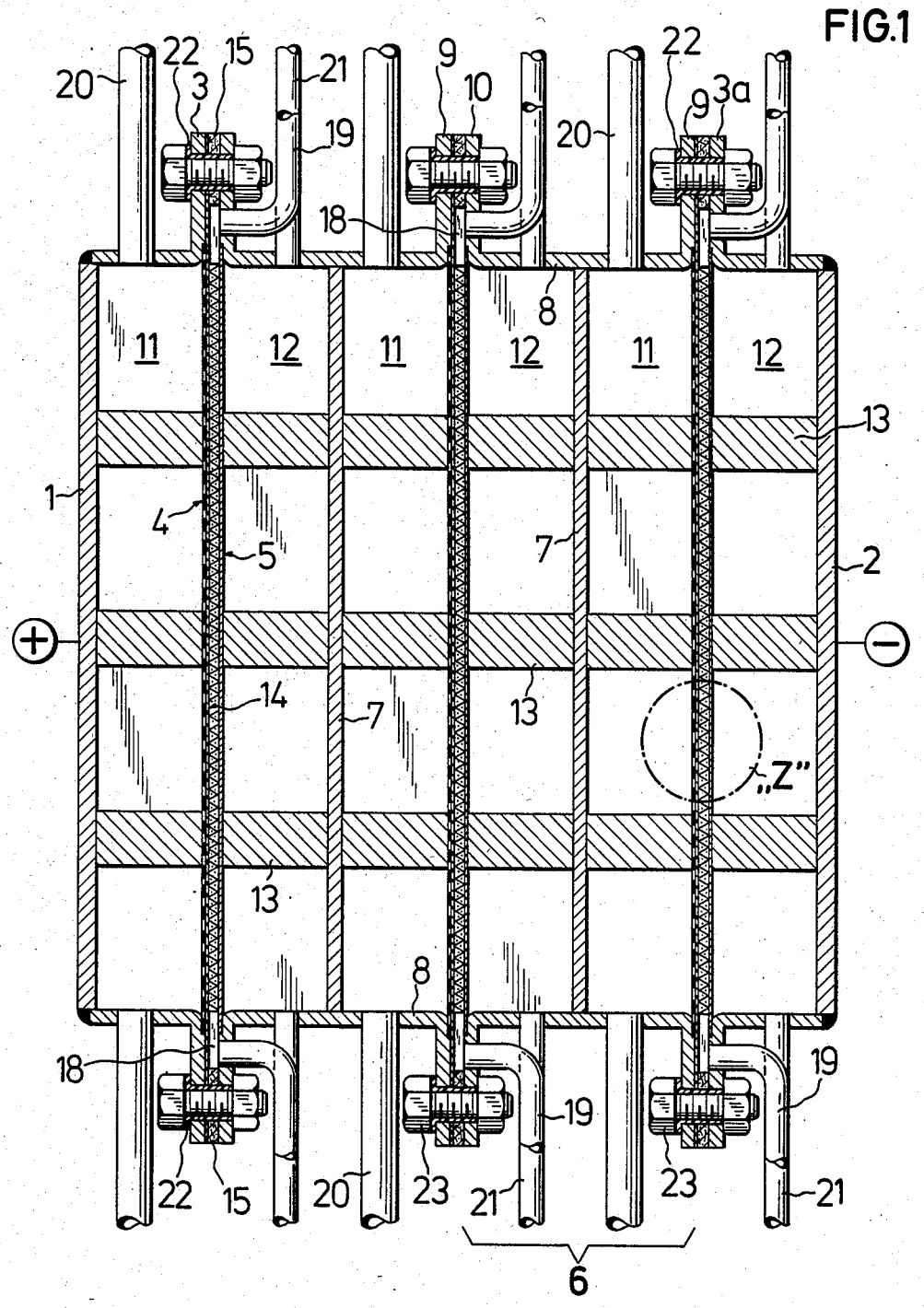
FIG. 1 shows a section through an electrolyzer comprising three bipolar cells (two elements according to FIG. 2 between the half-shells)

At least one element 6 is located between the half-shells 1 and 2, the edges of which are formed as flanges 3 and 3*a* and of which one carries an anode 4 and the other carries a gas diffusion cathode 5, such as is described, for example, in German Patent Application No. P 33 32 566.9. The element 6 has the form of a twin trough which is formed by a common plate 7 and a lateral wall 8, the height of which is divided by the plate. The plate 7 can also be arranged asymmetrically, so that the troughs have different depths. The edges of the wall, i.e. the free ends, are provided with flanges 9 and 10. Each flange 9, or the wall part adjoining it, carries an anode 4 and each flange 10, or the wall part adjoining it, carries a cathode 5. The space formed by the anode 4 and the trough is the anode space 11, and the space formed by the cathode 5 and the trough is the gas space 12. Struts 13 which protrude vertically from the plate and electrically conductively connect electrodes 4 and 5 to the plate 7 are arranged in the anode space 11 and the gas space 12. Partitions 14, such as ion exchanger membranes, diaphragms and the like, and sealing elements 15 are arranged between the flanges 3, 3*a*, 9, 10 of the half-shells 1, 2 and of the elements 6. The sealing element is composed of a caustic-resistant material, preferably PTFE. With respect to its thickness, the dimensions of the sealing element 15 are such that a cavity 16, namely the cathode space, is formed between the partition 14 and the cathode 5. It can be advantageous to provide a spacer 17 in the cavity 16 between the partition 14 and the cathode 5, which spacer sets a uniform distance between the cathode and the partition. The spacer is composed of a caustic-resistant material, such as, for example, PTFE or nickel. A cathode space depth of about 2 to 3 mm is preferred, and a depth of 0.5 to 1 mm is particularly preferred. The sealing element 15 can be provided with recesses 18 which connect the cavity 16 to devices 19 for feeding and discharging the catholyte. The anolyte is fed and discharged via the lines 20, and gas (air, oxygen) for the oxygen-consuming cathode is fed and discharged via the lines 21. The half-shells 1, 2 and the elements 6 are joined by means of bolts 23 passing through bushing 22 of an electrically insulating material. The current leads are marked with plus and minus signs. The partition 14 can rest on the anode 4.

We claim:

1. A bipolar electrolysis apparatus with an anode and an oxygen-consuming cathode for the production of chlorine from aqueous alkali metal chloride solution in combination with means for supplying electrolysis current to the apparatus, means for supplying electrolysis feed materials to the apparatus, and means for discharging electrolysis output products from the apparatus, a partition arranged to separate the anode and cathode from one another, the electrolysis apparatus comprising at least one element (6) in the form of a twin trough located between two half-shells (1, 2) each having edges formed as a flange (3, 3*a*) and of which one flange carries an anode (4) and the second flange carries a cathode (5), which twin trough is formed by a common plate (7) and a lateral wall (8), the height of which is divided by the plate and the edges of which are provided with flanges (9, 10), the anode (4) and the cathode (5) which are separated from one another in space by the plate (7) being electrically conductively connected to the wall (8) and to struts (13) which protrude vertically from the plate (7) on both sides, the partitions (14) being clamped in between the flanges (3, 3*a*, 9, 10) of the half-shells (1, 2) and of the element (6), and sealing elements (15) being arranged in such a way that a cavity (16) is formed between the partition (14) and the cathode (5).

2. The electrolysis apparatus as claimed in claim 1, wherein two elements (6) are located between the half-shells (1, 2), a partition (14) is clamped in between the flanges (10, 11) of the elements (6), and a sealing element (15) is arranged in such a way that a cavity (16) is formed between the partition (14) and the cathode (5).

3. The electrolysis apparatus as claimed in claim 1, wherein a spacer (17) is located between the partition (14) and the cathode (5), and the sealing element (15) has recesses (18) which connect the cavity (16) between the partition (14) and the cathode (5) to devices (19) for feeding and discharging the catholyte.

4. The electrolysis apparatus as claimed in claim 1, wherein the material used for the half-shells (1, 2) and the elements (6) is titanium.

5. The electrolysis apparatus as claimed in claim 1, wherein the anode (4) used is a titanium anode which has been activated with an oxide or mixed oxide of the metals of the 8th subgroup of the Periodic Table.

6. The electrolysis apparatus as claimed in claim 1, wherein the cathode (5) used is a gas diffusion cathode comprising a current collector of nickel fabric, which is coated with a porous colloidal silver catalyst deposited on polytetrafluoroethylene, and having a hydrophilic top layer on the long side.

* * * * *